US007108438B2

(12) United States Patent
Fontaine

(10) Patent No.: US 7,108,438 B2
(45) Date of Patent: Sep. 19, 2006

(54) PACKAGING AND APPLICATOR DEVICE FOR A COSMETIC PRODUCT AND/OR A BEAUTY CARE PRODUCT INCORPORATING A MEANS OF HEATING

(75) Inventor: Michel Fontaine, Paris (FR)

(73) Assignee: L'Oreal, Paris (FR)

( * ) Notice: Subject to any disclaimer, the term of this patent is extended or adjusted under 35 U.S.C. 154(b) by 252 days.

(21) Appl. No.: 10/807,121

(22) Filed: Mar. 24, 2004

(65) Prior Publication Data

US 2004/0247367 A1 Dec. 9, 2004

Related U.S. Application Data

(60) Provisional application No. 60/462,711, filed on Apr. 15, 2003.

(30) Foreign Application Priority Data

Mar. 24, 2003 (FR) ..... 03 03578

(51) Int. Cl.
*A46B 11/08* (2006.01)

(52) U.S. Cl. ..... 401/1; 401/122; 401/129; 219/424; 219/439; 312/269

(58) Field of Classification Search ..... 401/1, 401/2, 121, 122, 126, 129; 219/385–387, 219/421, 424–426, 430, 433, 439, 441; 132/218, 132/269, 271, 313, 317; 392/441, 443, 444
See application file for complete search history.

(56) References Cited

U.S. PATENT DOCUMENTS

| | | | | |
|---|---|---|---|---|
| 5,775,344 | A | 7/1998 | Clay | |
| 5,856,653 | A | 1/1999 | Boudreaux | |
| 2005/0031400 | A1 * | 2/2005 | Marcotte et al. | 401/129 |
| 2005/0058496 | A1 * | 3/2005 | De La Poterie et al. | 401/1 |

FOREIGN PATENT DOCUMENTS

| | | |
|---|---|---|
| FR | 2743991 | 8/1997 |
| WO | WO 99/22782 | 5/1999 |

* cited by examiner

*Primary Examiner*—Huyen Le
(74) *Attorney, Agent, or Firm*—Oblon, Spivak, McClelland, Maier & Neustadt, P.C.

(57) ABSTRACT

A packaging and applicator device for a formulation used, for example, for make-up and/or care of keratinic fibers. The device includes a reservoir in which the formulation is placed, and an applicator capable of being loaded with a quantity of the formulation. The reservoir includes a heating device capable of heating at least a portion of the applicator and the quantity of product with which it is loaded when the device is not in a closed position of the reservoir. Heating is preferably permitted when the applicator is in an intermediate position, held at the level of an opening in the reservoir, with the circumference of this opening having at least one heated wall. The heated wall preferably incorporates a stripper element mounted in the reservoir opening.

55 Claims, 4 Drawing Sheets

-1-

-1-

-12-

-12-

PACKAGING AND APPLICATOR DEVICE FOR A COSMETIC PRODUCT AND/OR A BEAUTY CARE PRODUCT INCORPORATING A MEANS OF HEATING

CROSS REFERENCE TO RELATED APPLICATIONS

This document claims priority to French Application Number 03 03578, filed Mar. 24, 2003 and U.S. Provisional Application No. 60/462,711, filed Apr. 15, 2003, the entire contents of which are hereby incorporated by reference.

FIELD OF THE INVENTION

The invention relates to a packaging and applicator device for a cosmetic product and/or a beauty care product incorporating a heating device.

BACKGROUND OF THE INVENTION

Discussion of Background

U.S. Pat. No. 5,856,653 describes a heating container that includes a recess which can accommodate a tube containing a cosmetic product. The container is arranged so as to impart a slow heating action by transference of the heat emitted by the container through the walls of the tube to the cosmetic product contained therein. The container can be used to heat and possibly re-fluidize residues of product that have dried on the tube walls, thereby rendering them re-usable for a fresh application of the cosmetic product.

U.S. Pat. No. 5,775,344 describes an arrangement having a tube containing a cosmetic product in which the walls of the tube directly incorporate a means of heating arranged so as to heat the product contained in the tube by conduction. The means of heating the tube wall performs the same function as the external heating container. In effect, it enables product residues dried onto the internal walls of tube to be re-fluidized, thereby rendering them re-usable for a fresh application of the cosmetic product.

According to the teachings of the art, it is known that a product held in a container can be heated in order to recover residues of the product that have dried onto the internal walls of the container. In this manner, the entire product is heated. To use the product, a quantity of the heated product is taken up by means of an applicator. The product is therefore applied hot, which can impart useful cosmetic properties to the product, for example, by improving the curl of the eyelashes to which it is applied.

In order to raise the temperature of the quantity of product taken up sufficiently to confer these desired cosmetic properties, it is necessary to heat the entirety of the product. This technique poses a problem associated with premature aging of the product not being used for a given application, and when this product is used in subsequent applications, it will have been re-heated numerous times. Aging can cause deterioration of the cosmetic properties of the product, for example, volatilization of the solvents contained in the product formulation. Moreover, as the product is being heated, temperature gradients form inside the device, and the quantity of product taken up can also have this temperature gradient or be inconsistent as a result of this gradient, resulting in uneven deposition of make-up during a given application.

There is thus a need to heat the quantity of product applied at the time of use and in a uniform manner without requiring heating of all of the product in the container. To this end, the current state of the art involves a two-step procedure. In the first step, a quantity of product is applied at ambient temperature, and in the second step the applied product is then heated by means of a known device such as that described in document FR-A-2,743,991.

SUMMARY OF THE INVENTION

The object of the invention is to simplify the actions entailed in applying make-up, while at the same time limiting or reducing the aging or potential deterioration of a cosmetic product held in a container in a quantity such that it can be used for numerous or plural successive applications. The device according to the invention enables a quantity of product used for immediate application to be heated, while a remaining quantity of the product contained in the device can remain at ambient temperature. The invention is useful notably for the application of mascara to keratinic fibers such as the eyelashes or eyebrows.

The device according to the invention implements a means of heating designed to heat a limited quantity of product. In a preferred form, the quantity of product that is heated is limited to an amount associated with a single application. By virtue of this, the heating means provided in the device can have a lower electrical capacity or reduced electrical requirements, thereby reducing the excess weight attributable to the heating means. Furthermore, the heating time can be reduced.

A packaging and applicator device according to an embodiment of the invention includes a reservoir holding a product to be applied, in particular a cosmetic product, and a means of application mounted on the reservoir. The reservoir includes a means of heating. In particular, the heating means allows the applicator tip of the application means to be heated as it is being withdrawn from the reservoir, before being completely disengaged from the reservoir. In this intermediate position, between the closed position and a free position of the applicator enabling application of the product, the reservoir is preferably designed so that the applicator tip of the application means impregnated with a quantity of product is heated.

In accordance with one example of an advantageous embodiment, the invention provides a packaging and applicator device for a make-up and/or care product formulation for keratinic fibers, including a reservoir having an opening. The formulation is placed inside the reservoir, and a means of applying the formulation capable of being loaded with a quantity of the formulation is insertable into the reservoir from the opening. In addition, a means of stripping excess product is preferably mounted on the reservoir in proximity to the opening. In a preferred form, the stripping means includes a means of heating capable of heating an applicator tip attached to the application means together with the quantity of product held on the tip, at least when the applicator tip passes through the heating means.

Preferably, the heating means is provided at the level of an inner wall of the reservoir opening, in particular at the level of an inner circumference of a neck situated below the opening. Notably in this case, the neck preferably has a height substantially equal to the length of an applicator portion of the application means.

By way of example, the application means can be held on the reservoir in a closed position of the device, thus enabling combined storage of the reservoir and the application means.

The heated wall or walls of the heating means can be arranged so that the application means is scraped, preferably over its entire circumference, by an edge of the heated wall/walls when the application means passes through the opening. In effect, when the application means passes through the opening, given the position of the stripping means, it also passes through the stripping means. The application means passes through the opening and the stripping means after disengaging from the closed position, so that it can then be used to freely apply the product, for example, to deposit mascara onto keratinic fibers requiring make-up.

Preferably, the edge of the stripping means performing the scraping action is that furthest away from the opening and therefore closest to the reservoir. Thus, the excess quantity of product on the application means which is scraped off the outer circumference of the application means is therefore not heated between the walls of the stripper. This arrangement makes it possible to better confine the heating action to a reproducible or nearly reproducible quantity of product. Preferably, the amount heated is only that associated with a single application or close to that associated with a single application.

According to a preferred embodiment, to maintain at least part of the application means in contact with the heating means, the application means includes retaining means to assist in positioning or holding the application means (and the quantity of product impregnated thereon) partially withdrawn from the reservoir and to remain in this intermediate heating position.

Advantageously, the application device includes an applicator placed at the end of a rod. The rod, in turn, is mounted in a cap which preferably includes means to maintain the device in a closed position in cooperation with counterpart means on the reservoir. The applicator is located inside the reservoir in this closed position. The cap includes, for example, a screw thread designed to engage with a threaded external wall of the reservoir.

Preferably, the applicator can be placed in contact over its full length with the wall or walls of the heating means.

Advantageously, the heating means preferably includes a power source, preferably a direct current source, in particular in the form of a battery, preferably a rechargeable battery. For example, the battery can be rechargeable on a base of a recharging unit which can in turn be plugged into a power source or outlet. In the case of a non-rechargeable battery, a conventional alkaline cell is used.

To selectively activate or deactivate the heating of the application means and the quantity of product contained thereon before application, the heating means can include a switch to selectively enable the heated wall or walls of the heating means to be electrically energized. This switch can be positioned, for example, such that it is made accessible when the application means is placed in its intermediate position relative to the reservoir, i.e., when the device is disengaged from the closed position.

Advantageously, the heating means includes a means to visually monitor the heating process. To this end, an indicator, for example, a diode, is electrically connected to the heated walls such that it is visible from an external wall of the reservoir.

Preferably, the switch is fitted with an electronic device to control the heating means. This control device can then be used to regulate the heating time and the heating temperature.

By way of example, the heated wall or walls of the heating means can include an electric heating element in the walls. According to a first embodiment, the electric heating element is formed by an over-molded metal wire in a plastic wall of the heating means. According to a second embodiment, the electric heating element is formed by a metal wire seated in a helical groove in an internal wall of an insulating part. Finally, in a third embodiment, the electric heating element is obtained by bi-injection of at least two materials, with the first material being a conductor and the second material being an insulator.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
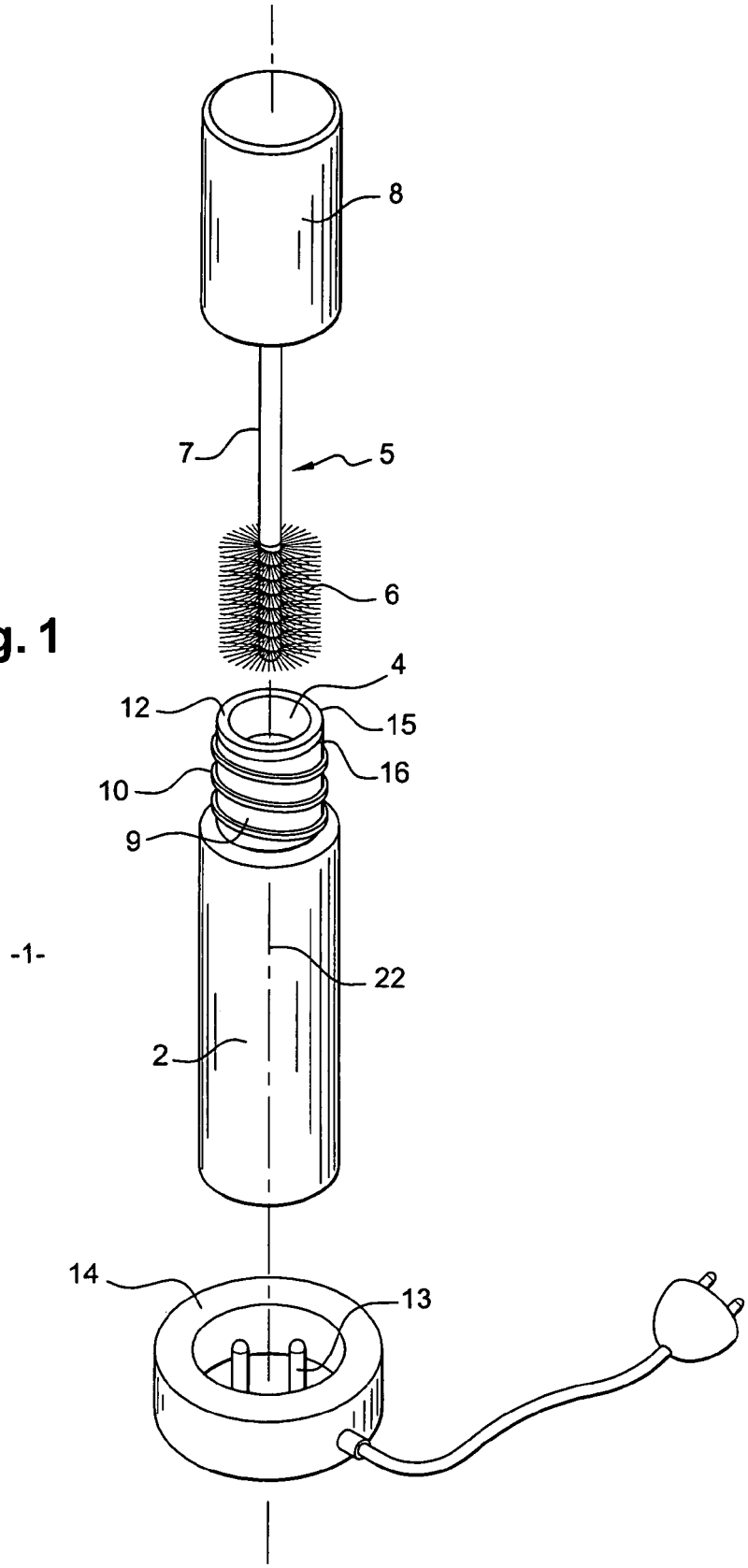
FIG. 1 is a perspective view of a first embodiment of a packaging and applicator device according to the invention, in the open position.

FIG. 1 shows an example of a packaging and applicator device 1 according to the invention. This device 1 includes a reservoir 2 in which a quantity or supply of a product 3 is stored. This product 3 is, for example, a make-up and/or beauty care formulation for keratinic fibers, which includes, for example, a mascara type formulation.

The reservoir has, for example, an elongated tubular shape, such that the reservoir 2 includes an opening 4 from which the product 3 can be extracted from the reservoir 2. The opening 4 is, for example, defined on the lengthwise axis of the tube. For example, to apply a quantity of product, an application means or applicator 5 of the device 1 is used, which is capable of passing through this opening 4 in order to take up a quantity of product from the reservoir 2.

The application means 5 includes, for example, an applicator tip 6 mounted at the end of a rod 7, this rod 7 being in turn mounted in a cap 8. The applicator tip 6 serves to take up a quantity of product. The applicator tip is, for example, made of foam, flock, or bristles. The cap 8 is, for example, designed to be retained on the reservoir 2 when the application means 5 is inserted into the reservoir 2 so that the device 1 thus mounted is in the closed position.

By way of example, an outer circumference of a neck 9 formed below the opening 4 can be provided with a screw thread 10 designed to engage with a threaded portion 11 on an inner circumference of a wall of the cap 8 forming a skirt around the rod 7.

In FIG. 1, the device 1 is in the open position, and the application means 5 is free to be used to apply the quantity of product 3 with which it is loaded. The applicator tip 6 shown in this example is a brush designed to apply product to the eyelashes.

Figure 2A:
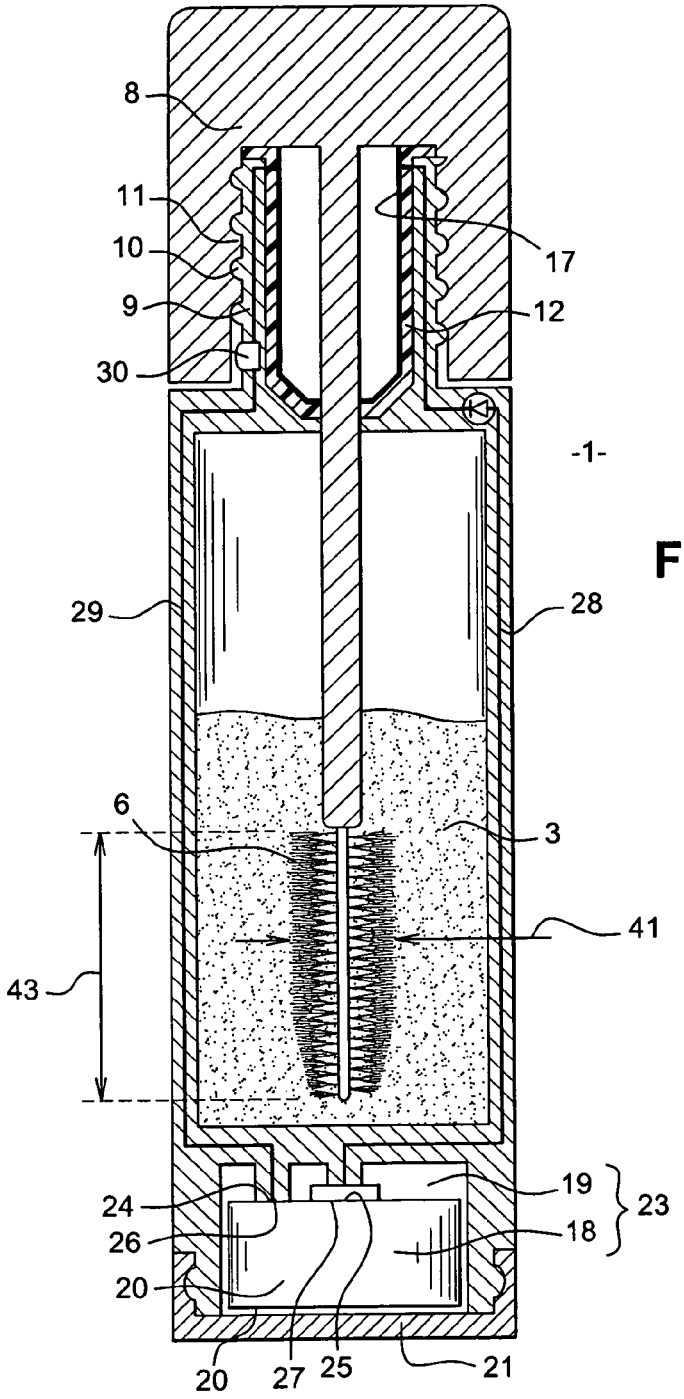
FIG. 2A is a cross-sectional view of a second embodiment of a packaging and applicator device according to the invention, in the closed position.

FIG. 2A shows the application means 5 mounted on the reservoir 2 in the closed position. The threaded part 11 presented by the cap 8 is engaged in the screw thread 10, and the applicator tip 6 is immersed in the product 3.

The reservoir 2 includes a heating device 12, for example, incorporated into the wall or walls of the reservoir 2. In the illustrated arrangements, the heating means 12 is placed at the level of the neck 9. For example, the heating means 12 includes a collar 15 (FIGS. 4–6) which bears against an edge 16 of the walls of the reservoir, at the level of the opening 4. By way of example, the heating device can include an insert (FIGS. 4–6) which is insertable into the neck of the reservoir.

Thus, as the application means 5 is removed from the reservoir 2, the rod 7, then the applicator tip 6, pass through opening 4 and therefore through the heating means 12 which incorporates at least one heated wall 17 placed below this opening 4. During this movement, the applicator tip 6 is withdrawn from the product after first being charged with a quantity of the product. During the passage through opening 4, the heated wall or walls 17 of the heating means 12 are arranged so that they are able to come into contact at least with a portion of the outer circumference of the applicator tip 6. Preferably, the heated wall 17 comes into contact with the whole surface presented by the external circumference of the applicator tip 6. For example, the applicator tip can be a brush of cylindrical form, and in a complementary manner the heated wall 17 can be arranged so as to define a cylindrical space of dimensions adapted to those of the brush. When the applicator tip 6 is thus placed between or within the heated wall or walls 17, the device 1 is in an "intermediate" position.

Advantageously, the applicator tip 6 is held between these heated walls 17 for a certain length of time. The benefit of positioning the heating means 12 below the opening 4 is that the user can reheat the applicator tip 6 several times without having to recharge it with product. Furthermore, heating action is thus applied directly to the external circumference of the applicator tip 6, and it is this same surface that will then be applied to a surface requiring make-up. This heating stage is preferably rapid so that the applicator need only be in the intermediate position for a short period of time.

Figure 2B:
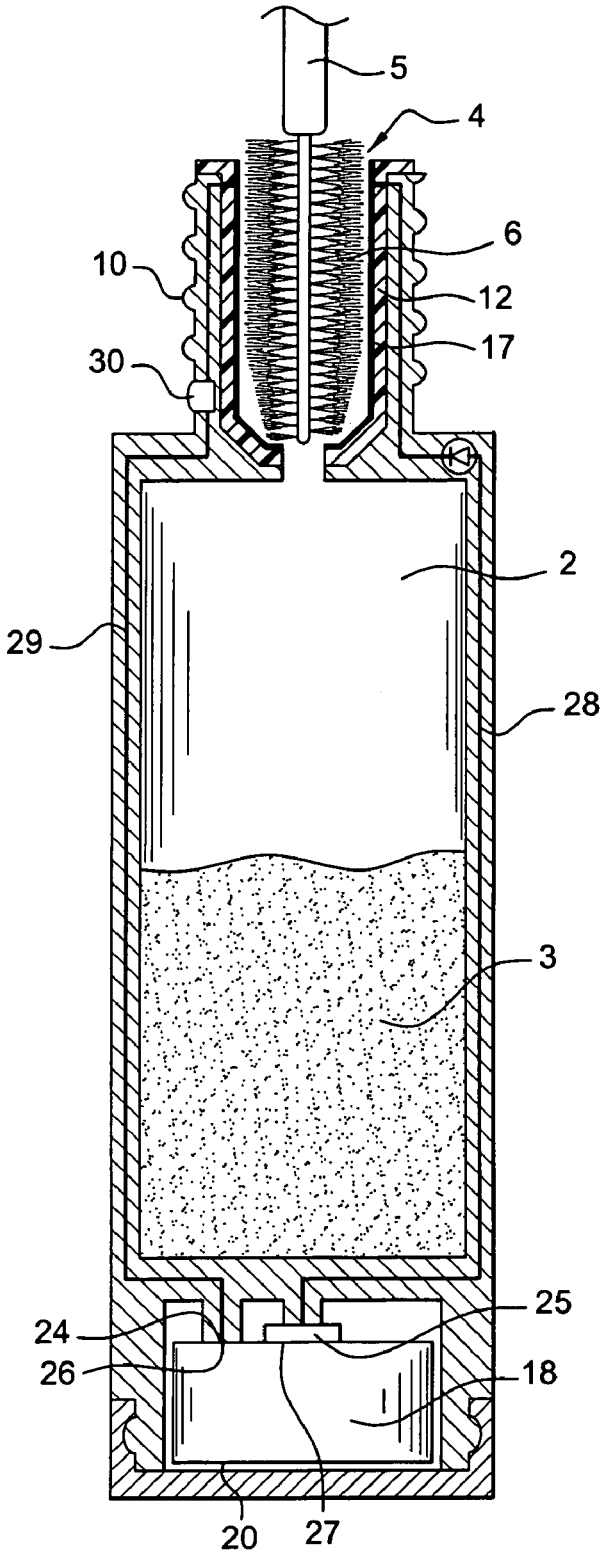
FIG. 2B is a sectional view of a second embodiment of a packaging and applicator device according to the invention, in the intermediate position.

Preferably, the device 1 includes means to hold this intermediate position in balance. Preferably, the respective weights of the reservoir 2 and the application means 5 are defined so that the intermediate position is stable. To this end, during the heating time, the reservoir can be left standing on a support, with the application means 5 placed above and extending into the opening 4, as illustrated in FIG. 2*b*.

When the heating means 12 is powered by a battery 18, the latter is preferably mounted in a base 19 of the reservoir 2 opposite the opening 4 on a principal lengthwise axis 22 of the reservoir 2. Thus, the center of mass of the masses associated with each of the elements constituting the device 1 is located at a level inside the reservoir 2, for example, along the axis 22. In a variant, the battery 18 can be placed in a recess accessible from a side face of the reservoir 2, this side face being orthogonal to the base 19. In this case, elongated and tubular batteries can be used, for example, type AA, arranged so that their principal lengthwise axis is parallel to the principal lengthwise axis 22 of the reservoir 2.

In the illustrated arrangement, by way of example, the base 19 includes an opening 20 for insertion of the battery 18 in a removable manner. The base 19 is fitted with a cover 21 to close off access to the battery in a selective manner. The opening 20 is preferably opposite the opening 4 on the axis 22.

By way of example, the device 1 can be additionally equipped with rods that are mobile relative to the reservoir 2 and capable of being selectively held in a low position enabling the application means 5 to be mounted on the reservoir to achieve the "closed" position, or held in a high position enabling the axis of the rod 7 to be maintained in the axis of the opening 4, and bearing on an edge of the cap 8. These rods can, for example, slide in grooves provided on the outer circumference of the wall of the reservoir 2. They can, for example, be moved from their low position to the high position simply by disengaging the application means 5 from the reservoir, when the latter is brought from the closed position to the intermediate position.

According to a first variant of the invention, FIG. 1, the battery 18 is rechargeable, and can notably be recharged by contact with pins 13 presented by a base 14 in turn connected to a power source such as an electrical outlet.

The battery 18 is connected to the heated walls 17 by a connecting means 23. This connecting means 23 includes two terminals 24 and 25 designed to make contact respectively with two poles 26 and 27 presented by the battery 18. The connecting means 23 includes two conducting tracks 28 and 29 formed within the thickness of the wall of the reservoir 2. In the illustrated arrangement, these tracks rise from the base 19 to the neck 9 where the heating means 12 is located together with the associated heated walls 17.

The heated walls 17 are connected to the tracks 28 and 29. In the illustrated arrangement, the heating means 12 include an element or insert fitted to the reservoir 2, and the tracks 28 and 29 are defined within the thickness of the reservoir 2. The tracks present contact surfaces so that when the insert is inserted into the neck, they contact corresponding contact surfaces of the insert to electrically couple the heating means to the power supply. In order to facilitate their connection, one or more contact surfaces are provided. For example, a circular ring is formed on an outer circumference of the heating means 12 designed to make mechanical contact (preferably without compression) with the tracks 28 and 29 projecting beyond an internal circumference of the neck 9. In one variant, provision can be made to index or guide the position of the heating means relative to the tracks 28 and 29 such that a smaller contact area can be provided, on the outer circumference of the heating means, for example a contact zone or contact surface of dimensions complementary to the points at which the tracks 28 and 29 emerge from the inner circumference of the reservoir 2.

Figure 3:
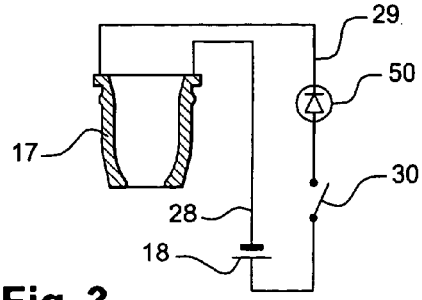
FIG. 3 is a schematic electrical wiring diagram of a device according to the invention.

A simplified schematic diagram of the electrical circuit is shown in FIG. 3. The battery 18, the tracks 28 and 29 and the heated walls 17 form a closed circuit. Preferably, a switch 30 is provided to selectively activate or deactivate heating of the heated walls 17. The switch 30 can take the form, for example, of a push-button 30 (FIGS. 2A and 2B) located on the outer circumference of the neck 9. Heating of the walls 17 can thus be prevented when the device 1 is in the closed position, with access to the push-button being masked or concealed by the cap 8 in this position. According to the diagram in FIG. 3, the power supply circuit can include a light-emitting diode 50 mounted on the track 29. The track 29 is incorporated within the wall thickness of the reservoir 2, and the diode 50 is preferably also incorporated into this wall, and in a manner such that the light signal emitted by this diode 50 is visible from the outside of the reservoir 2.

The heated walls 17 are preferably heat-dissipating electrical resistances surrounded by an electrically insulating material designed to come into contact with the applicator tip 6 and to electrically isolate these electrical resistances.

The heating means 12 of the illustrated embodiments includes an electrically insulating support 31 having good heat conductivity, roughly tubular in shape and incorporating a channel 32 allowing the application means 5 to pass through from its closed position to the free position via the intermediate position. In the preferred embodiments, the dimensions and shape of the channel 32 are determined in relation to the geometry of the outer circumference of the applicator tip 6. The support 31 includes a heat-dissipating resistance 33, 35 (FIGS. 4 and 5) and 36 (FIG. 6) in the following examples, held in the support 31 so that the heat is dissipated towards the channel 32. The heated wall 17 is the wall forming the inner circumference of the support 31.

As shown in the drawings, in the illustrated embodiments, the applicator tip passes through first and second apertures when the applicator is removed from the reservoir. In the illustrated embodiments, the second aperture is adjacent the top of the neck, while the first aperture is smaller than the second aperture and smaller than the outer diameter of the applicator tip. As illustrated, the first aperture can be located, for example, near a base of the neck.

The tracks 28 and 29 are, for example, made of metal wires over which the reservoir 2 is molded. As a variant, they can be obtained by bi-injection of the body of the reservoir 2, with the reservoir being made from an insulating material, while the tracks are made from a conducting material. In another variant, the tracks 28 and 29 can be screen-printed onto a first molding of the reservoir body, with this first molding then being over-molded to provide electrical insulation and to give the reservoir 2 its final shape.

Figure 4:
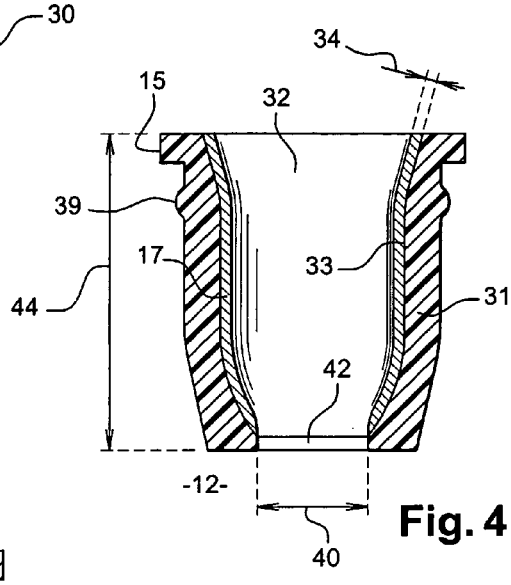
FIG. 4 is a cross-sectional view of a first heating arrangement that can be used in a device according to the invention.

According to a first embodiment illustrated in FIG. 4, the heat-dissipating layer forms a tube 33 made of a conducting material. This tube 33 is connected to the tracks 28 and 29 and is incorporated into the thickness of the insulating support 31. Preferably, the thickness 34 of the insulation 31 on the side facing the channel 32 is small in order to achieve better heat diffusion. This type of heating means 12 is obtained, for example, by bi-injection.

Figure 5:
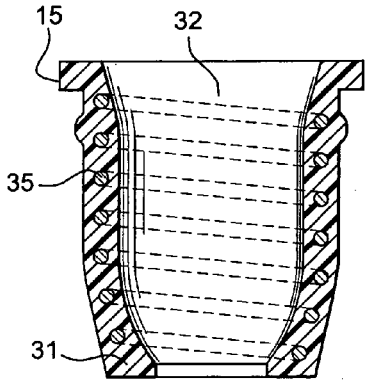
FIG. 5 is a cross-sectional view of a second heating arrangement that can be used in a device according to the invention.

According to a second embodiment illustrated in FIG. 5, the heated wall 17 is formed from a metallic (or other electrically conductive material) helical structure 35 over-molded with the insulating material of the support 31. In the illustrated arrangement, the axis of the helix 35 is superimposed on the axis of the channel 32. The metallic structure 35 is connected to the tracks 28 and 29.

Figure 6:
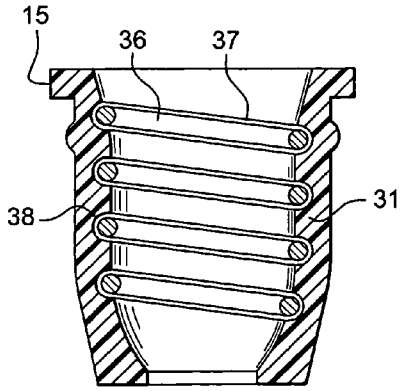
FIG. 6 is a cross-sectional view of a third heating arrangement that can be used in a device according to the invention.

In a third embodiment illustrated in FIG. 6, the heated wall 17 is formed from a metallic helical structure 36 sheathed with insulating material 37 and held in a groove 38 formed in the inner circumference of the support 31. The helix can therefore be assembled last into the groove 38 or after the supported is formed.

Preferably, the heating means 12 also performs a stripping function at the level of the outlet opening 4. The shape of the support 31 is adapted to perform this stripping function. The support 31 is generally a component fitted to the body of the reservoir 2. For this purpose, by way of example, in the illustrated arrangement the support 31 presents on its outer circumference means 39 facilitating attachment on the reservoir 2. These means 39 are, for example, bosses designed to press against an inner wall of the neck 9. The support 31 is, for example, fitted after the reservoir 2 has been filled with the product 3.

To perform the stripping function, the channel 32 forms a first aperture associated with the neck of the reservoir, with an inside diameter 40 smaller than the outside diameter 41 of the applicator tip 6. This neck portion is preferably formed at the level of an aperture 42 in the channel 32 nearest to the product 3 and the inside of the reservoir 2. The edge of the support 31 or first aperture defined at the level of this neck portion performs the stripping function. Opposite the neck portion of the first aperture, the channel 32 provides a neck portion having a second aperture of inside diameter larger than the outside diameter 41 of the applicator tip. This second aperture is coincident with the opening 4 at the top of the neck of the reservoir.

The applicator tip 6 has a length 43, defined along the axis of the rod 7, less than or equal to a height 44 of the heated walls 17, this height being measured on the axis 22 of the reservoir 2 on which the support 31 is mounted.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging and applicator device for a formulation for make-up and/or care of keratinic fibers, including:

a reservoir having an opening, the formulation being disposed inside the reservoir;

application means for applying the formulation, wherein the application means includes an applicator tip which is capable of being loaded with a quantity of the formulation, and wherein the application means is insertable into the reservoir through the opening;

stripping means mounted on the reservoir in proximity to the opening; and wherein the stripping means includes heating means capable of heating the applicator tip with the quantity of product held on the applicator tip at least when the applicator tip passes through the heating means.

2. A packaging and applicator device according to claim 1, wherein the heating means is positioned at a level of an inner circumference of a neck situated below the opening.

3. A packaging and applicator device according to claim 2, wherein the application means can be mounted on the reservoir in a closed position of the device.

4. A packaging and applicator device according to claim 3, wherein the heating means includes at least one wall, the packaging and applicator device further including means to hold the application means, in an intermediate position, adjacent the at least one wall of the heating means.

5. A packaging and applicator device according to claim 1, wherein the heating means includes at least one wall, the packaging and applicator device further including means to hold the application means, in an intermediate position, adjacent the at least one wall of the heating means.

6. A packaging and applicator device according to claim 5, wherein the application means includes a rod, wherein the applicator tip is disposed at one end of the rod, and wherein the rod is in turn mounted to a cap incorporating means to hold the device in a closed position in cooperation with counterpart means on the reservoir, and further wherein the applicator is located inside the reservoir in said position.

7. A packaging and applicator device according to claim 1, wherein the application means includes a rod, wherein the applicator tip is disposed at one end of the rod, and wherein the rod is in turn mounted to a cap incorporating means to hold the device in a closed position in cooperation with counterpart means on the reservoir, and further wherein the applicator is located inside the reservoir in said position.

8. A packaging and applicator device according to claim 7, wherein the heating means includes at least one wall, and wherein a height of the at least one wall is at least as great as a length of the applicator tip.

9. A packaging and applicator device according to claim 8, wherein the applicator tip is in contact over its full length with the at least one wall of the heating means in an intermediate position.

10. A packaging and applicator device according to claim 5, wherein the applicator tip is in contact over its full length with the at least one wall of the heating means in the intermediate position.

11. A packaging and applicator device according to claim 1, wherein the heating means includes a power source.

12. A packaging and applicator device according to claim 11, wherein said power source is a direct current power source.

13. A packaging and applicator device according to claim 11, wherein said power source includes a battery.

14. A packaging and applicator device according to claim 11, wherein said power source includes a rechargeable battery.

15. A packaging and applicator device according to claim 11, further including a switch to selectively enable the heating means to be electrically energized, and wherein said switch is accessible when the application means is placed in an intermediate position to be heated.

16. A packaging and applicator device according to claim 5, further including a switch to selectively enable the heating means to be electrically energized, and wherein said switch is accessible when the application means is placed in said intermediate position to be heated.

17. A packaging and applicator device according to claim 16, further including means to visually monitor heating.

18. A packaging and applicator device according to claim 17, wherein said means to visually monitor includes a light-emitting device.

19. A packaging and applicator device according to claim 18, wherein said light-emitting device includes a diode.

20. A packaging and applicator device according to claim 1, further including means to visually monitor heating.

21. A packaging and applicator device according to claim 20, further including an electronic device to control the heating means.

22. A packaging and applicator device according to claim 1, further including an electronic device to control the heating means.

23. A packaging and applicator device according to claim 1, wherein the heating means includes an electrical resistance heater.

24. A packaging and applicator device according to claim 23, wherein the electrical resistance heater includes a wire disposed within a molded part.

25. A packaging and applicator device according to claim 1, wherein the heating means includes a wire seated in a helical groove on an inner wall of an insulating support.

26. A packaging and applicator device according to claim 1, wherein the heating means includes at least first and second materials, the first material being conductive and the second material being insulating.

27. A packaging and applicator device according to claim 26, wherein the first and second materials are bi-injection molded to form said heating means.

28. A packaging and applicator device according to claim 1, wherein said stripping means includes an insert having a heating element associated therewith, and wherein said insert is disposed in a neck of said reservoir.

29. A packaging and applicator device according to claim 28, wherein at least one electrical contact is associated with said neck, and further wherein said insert is electrically coupled to said at least one electrical contact when said insert is disposed in said neck, and wherein said device includes a power source which supplies power to said at least one electrical contact and to said heating element of said insert.

30. A device according to claim 29, wherein said power source includes a rechargeable battery associated with said reservoir, the packaging and applicator device further including a recharging unit, and wherein said reservoir is removably insertable into said recharging unit to recharge said rechargeable battery.

31. A device according to claim 28, wherein said insert includes first and second apertures, wherein the first aperture has diameter smaller than a diameter of said applicator tip.

32. A device according to claim 31, wherein said second aperture has a diameter larger than the diameter of said first aperture.

33. A device according to claim 32, wherein said second aperture is disposed adjacent a top of said neck and said first aperture is spaced therefrom in a direction toward an interior of said reservoir.

34. A device according to claim 33, wherein said heating element is positioned along said insert at a location between said first aperture and said second aperture.

35. A packaging and applicator device for a product comprising:

a reservoir having an opening, wherein a supply of a product is disposed in said reservoir;

an applicator device, wherein said applicator device is movable between first, second and third positions, and wherein in said first position one end of the applicator device is disposed in said supply of the product, and wherein in said third position said applicator device is removed from said reservoir and is outside of said opening, and further wherein said second position is an intermediate position between said first position and said third position, and wherein in said second position said one end of said applicator device is out of said supply of the product but at least partially disposed in said reservoir; and a stripping device which strips a portion of the product from the applicator at at least one location between the first position and the third position, the stripping device including a heating device associated therewith to heat said one end of said applicator device when said applicator device is in said second position;

wherein said applicator device is positioned in said first position to take up a quantity of product from said supply at said one end of said applicator device, the applicator device is then moved to said second position to heat said quantity of product associated with said one end, and then said applicator device is moved to said third position to remove said applicator device from said reservoir with the quantity of said product in a heated condition.

36. A packaging and applicator device according to claim 35, wherein said reservoir includes a neck, and wherein said stripping device is associated with said neck.

37. A packaging and applicator device according to claim 36, wherein said stripping device having said heating device associated therewith includes a heating element associated with an insert and wherein said insert is inserted in said neck.

38. A packaging and applicator device according to claim 37, wherein said insert includes a first aperture and a second aperture, and wherein said applicator device includes an applicator tip at said one end, and further wherein said first aperture has a diameter smaller than a diameter of said applicator tip.

39. A packaging and applicator device according to claim 38, wherein said second aperture is adjacent a top of said neck and said first aperture is spaced from said second aperture in a direction toward an interior of said reservoir, and further wherein said second aperture has a diameter larger than the diameter of said first aperture.

40. A packaging and applicator device according to claim 39, wherein said reservoir includes a power source associated therewith, and wherein at least one electrical contact is associated with said neck such that when said insert is inserted into said neck said power source is coupled to said heating element by way of said at least one electrical contact.

41. A packaging and applicator device according to claim 40, wherein said power source includes a rechargeable battery, the packaging and applicator device further including a recharging unit into which said reservoir is removably insertable to recharge said rechargeable battery.

42. A packaging and applicator device according to claim 35, wherein said reservoir includes a neck, and wherein said stripping device is associated with said neck and includes a first aperture and a second aperture associated therewith, wherein said applicator device includes an applicator tip at said one end, and wherein when said applicator device is disposed in said second position, at least a portion of said applicator tip is disposed between said first aperture and said second aperture.

43. A packaging and applicator device according to claim 42, wherein said first aperture has a diameter which is smaller than a diameter of said applicator tip.

44. A packaging and applicator device according to claim 43, wherein said second aperture is larger than said first aperture.

45. A packaging and applicator device according to claim 44, wherein said second aperture is adjacent a top of said neck and wherein said first aperture is spaced from said second aperture in a direction toward an interior of said reservoir.

46. A packaging and applicator device according to claim 45, wherein said heating device includes a heating element disposed along said neck at least at a location between said first aperture and said second aperture.

47. A packaging and applicator device according to claim 46, further including a closure member associated with a second end of said applicator device, wherein said closure member closes said reservoir when said applicator device is in said first position.

48. A packaging and applicator device according to claim 47, further including a switch which actuates said heating device, and wherein said switch is concealed when said applicator device is in said first position and said switch is accessible when said applicator device is in said second position.

49. A packaging and applicator device according to claim 35, further including a closure member associated with a second end of said applicator device, wherein said closure member closes said reservoir when said applicator device is in said first position.

50. A packaging and applicator device according to claim 35, further including a switch which actuates said heating device, and wherein said switch is concealed when said applicator device is in said first position and said switch is accessible when said applicator device is in said second position.

51. A packaging and applicator device according to claim 35, further including a visual indicator to indicate a heating state of said heating device.

52. A packaging and applicator device according to claim 51, wherein said visual indicator includes a light emitting device.

53. A packaging and applicator device according to claim 35, wherein said product disposed in said reservoir is an eyelash product.

54. A packaging and applicator device according to claim 35, wherein said product disposed in said reservoir is a cosmetic product.

55. A packaging and applicator device according to claim 35, wherein said product is a make-up and/or care product for keratinic fibers.

* * * * *